US006565034B1

(12) United States Patent
Hesse et al.

(10) Patent No.: US 6,565,034 B1
(45) Date of Patent: May 20, 2003

(54) METHOD AND DEVICE FOR CONNECTING MATERIAL STRIPS

(75) Inventors: Jürgen Hesse, Erkrath (DE); Reinhard Hehner, Haan (DE)

(73) Assignee: Jagenberg Papiertechnik GmbH, Neuss (DE)

( * ) Notice: Subject to any disclaimer, the term of this patent is extended or adjusted under 35 U.S.C. 154(b) by 0 days.

(21) Appl. No.: 09/889,129

(22) PCT Filed: Dec. 17, 1999

(86) PCT No.: PCT/EP99/10033

§ 371 (c)(1),
(2), (4) Date: Jul. 11, 2001

(87) PCT Pub. No.: WO00/41958

PCT Pub. Date: Jul. 20, 2000

(30) Foreign Application Priority Data

Jan. 13, 1999 (DE) ..... 199 01 026

(51) Int. Cl.[7] ..... B65H 19/18
(52) U.S. Cl. ..... 242/556.1
(58) Field of Search ..... 242/551, 552, 242/556.1

(56) References Cited

U.S. PATENT DOCUMENTS 4,668,328 A * 5/1987 Kyytsonen ..... 242/551
4,880,178 A * 11/1989 Goulette ..... 242/556.1
5,288,034 A * 2/1994 Schonmeier et al. ..... 242/551
6,161,793 A * 12/2000 Lindstrand ..... 242/556.1

FOREIGN PATENT DOCUMENTS

WO WO 90/10591 9/1990
WO WO 93/25460 12/1993

* cited by examiner

*Primary Examiner*—John M. Jillions
(74) *Attorney, Agent, or Firm*—Herbert Dubno

(57) ABSTRACT

A method and apparatus for connecting a trailing end of a cardboard or paper web running off an unwinding roll with a leading end of a new wound roll. A splice beam engages a trailing end of an unwinding roll and severs the trailing end from the residue on the unwound roll while applying a first adhesive strip thereto. The splice beam then presses that trailing end against the leading end of a new roll which has previously been provided with a second adhesive strip so that the trailing end is bonded by the splice beam to the leading end with the two adhesive strips thereby leaving little or no unbonded web at the connection.

8 Claims, 5 Drawing Sheets

METHOD AND DEVICE FOR CONNECTING MATERIAL STRIPS

CROSS REFERENCE TO RELATED APPLICATIONS

This application is a national stage of PCT/EP99/10033 filed Dec. 17, 1999 and is based upon German national application 199 01 026.9 of Jan. 13, 1999 under the International Convention.

TECHNICAL FIELD

The invention relates to a method of and to an apparatus for connecting the running out or trailing end of a web of material with the oncoming or leading end of the web of a new wound roll in the unwinding of material webs, especially of paper or cardboard webs.

STATE OF THE ART

In unwinding devices for wound rolls of webs of material, for example paper webs or cardboard webs, splicing devices are known which connect the end of the running out material web (trailing end) with the web beginning (leading end) of a new wound roll. In the unwinding of heavy paper rolls which are wound on continuous metal shafts (tambours) and which can have a web width of 8 m and greater and a weight in excess of 50 tons, the splicing usually requires the processing machine which is downstream of the unrolling device to be brought to standstill.

A method and an apparatus of the type described here is known from EP 0 462 157 B1 in which initially the running out web is separated from the rest roll (previously unrolled roll) and the end of the separated running out web is held while the rest roll is replaced by a new wound roll. At the starting end web of the new roll, an adhesive strip is applied which is pressed against the end of the running out web and thereby fastens the end of the new roll to the running out web.

In the known method and apparatus, a problem arises in that, with especially large and heavy wound rolls and large web widths, it is not possible to provide a reliable web connection with a web end that projects only to a limited extent. This has its origins in the fact that it is not possible to apply the adhesive strip to the starting end of the web of the new wound roll exactly parallel to the axis thereof. Furthermore, it is not possible to position the new wound roll peripherally with sufficient precision that the holding device can move the adhesive strip with precision against the web end. The imprecision in the application of the adhesive strip and/or in the positioning of the new wound roll means that the web end cannot end precisely at the adhesive strip. Rather a free nonbonded remainder of the web will project to create problems in the further processing of the wound roll, especially in a printing or transverse cutting machine.

OBJECT OF THE INVENTION

The invention has as its object an improvement in the method and apparatus described at the outset such that a connection can be produced without a projecting, nonbonded remainder of the web or with only a minimum of projecting nonbonded web remaining.

SUMMARY OF THE INVENTION

According to the invention, the end of the running out web is connected with the starting end of the web by means of two adhesive strips which are provided over the width of the web. Before splicing, a first adhesive strip can be applied with precision at the edge of the starting end of the new wound roll and the second adhesive strip can be applied precisely at the edge of the trailing end of the running out web. Upon connection of the webs, the end of the running out web is thus adhered to the beginning of the new web and the new web is so bonded to the running out web. Since the two adhesive strips can each be precisely positioned, there is neither a projecting web end of the new web nor a projecting free end of the running out web.

Preferably the second web strip is applied to the web end at a location in the web travel direction behind the web strip at the beginning of the web by pressing it against the new wound roll in order to minimize the thickness in the splicing region.

BRIEF DESCRIPTION OF THE DRAWING

The drawing serves to explain the invention based upon a simply illustrated exemplary embodiment.

It shows.

SPECIFIC DESCRIPTION

Figure 1:
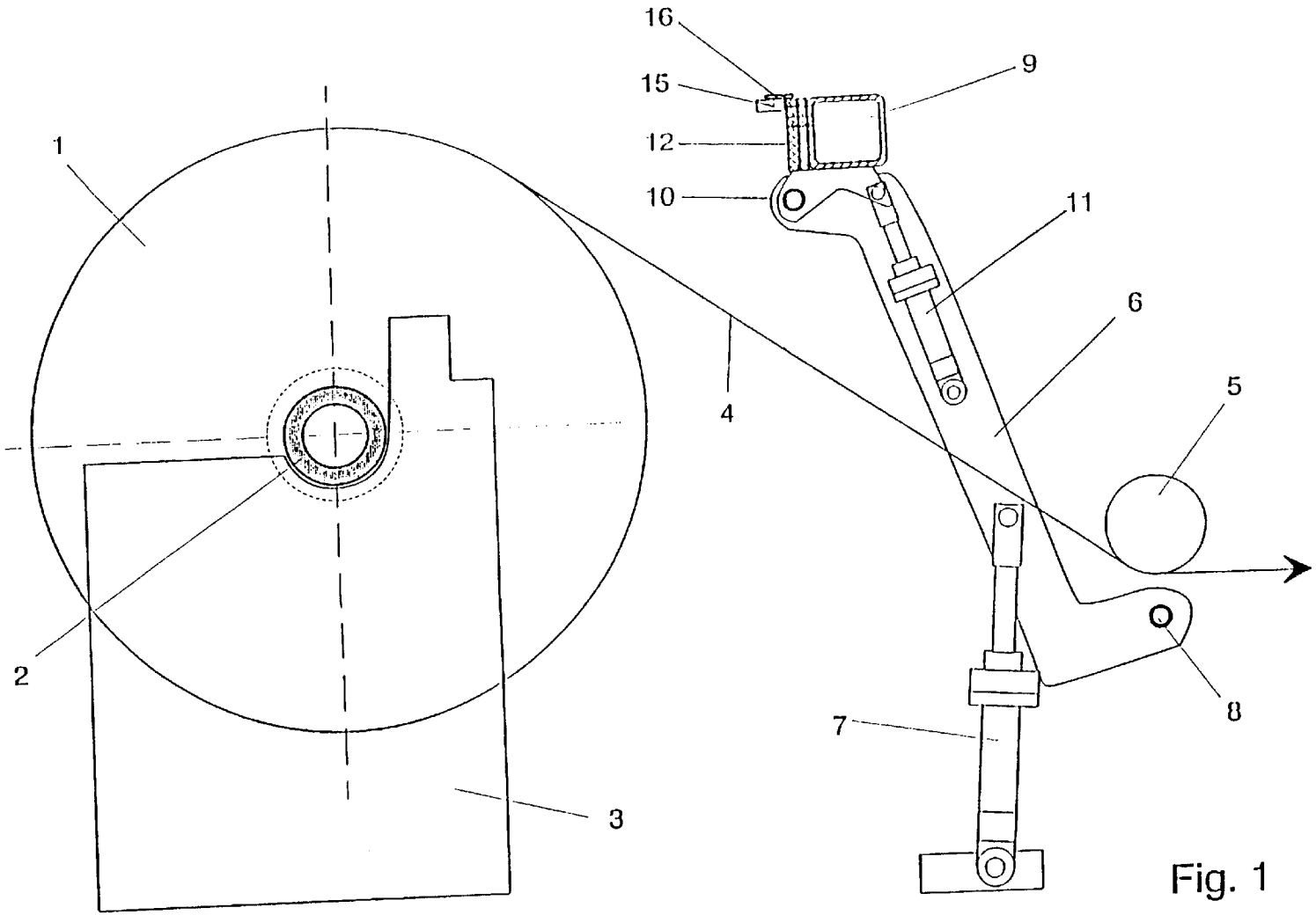
FIGS. 1 to 4 are side views showing the direction and manner of operation of an apparatus for connecting webs of material.

The embodiment of the invention shown in FIGS. 1–4 is a component of an unwinding apparatus for heavy paper rolls which have been wound on continuous strip shafts 2 which are described as tambours and can have a web width of 8 m or more and a weight in excess of 50 t. In FIG. 1 a side view of the unwinding apparatus during unwinding has been shown.

The wound roll 1 is suspended with its tambour in an unwinding frame having two lateral stands 3. A lateral brake generator, which can provide a motor drive for the wound roll and can brake the wound roll in a generator operation, has not been illustrated in the simplified drawing. The paper web 4 is withdrawn from above and routed around a guide roller 5 to a following roll-cutting and winding machine in which it is subdivided longitudinally into individual strips and wound up into smaller wound rolls.

Figure 3:
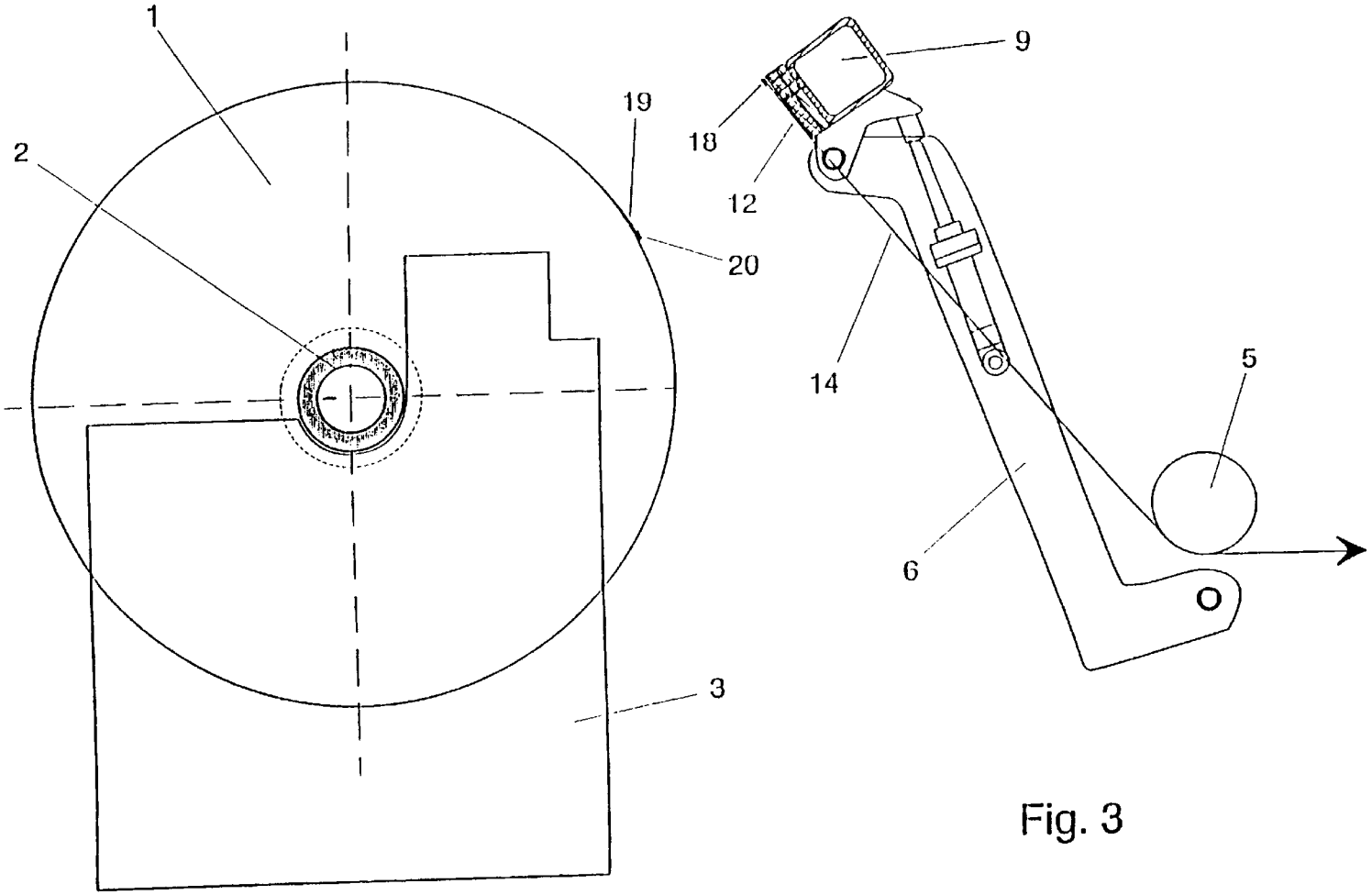

The apparatus according to the invention for connecting the webs comprises two lateral pivot levers which are swingably mounted respectively outside the region of the web 4 by means of a piston-and-cylinder unit 7 so as to be able to swing about a pivot axis 8 below the guide roller 5. At the free end of each pivot lever 6, a respective splicing element extending over the working width is fastened and contains a web-holding device. In the present example, the splicing element is a splice beam 9 which has a hollow interior and is illustrated in a nozzle form in FIGS. 5 and 6. The splice beam 9 is pivotally mounted on the pivot lever 6 to rotate about an axis 10 parallel to its longitudinal direction by means of a piston-and-cylinder unit 11 so that its front wall 12 turned toward the wound roll 1 can be oriented parallel to the web 4. The front wall 12 contains a row of suction channels 13 whose outer openings form a suction zone with which the end of the running off web 14, as illustrated in FIG. 3, can be held after the separation of the web 4. To generate the suction which holds the web 14, the interior of the beam 9 is connected to a suction blower.

Figure 2:
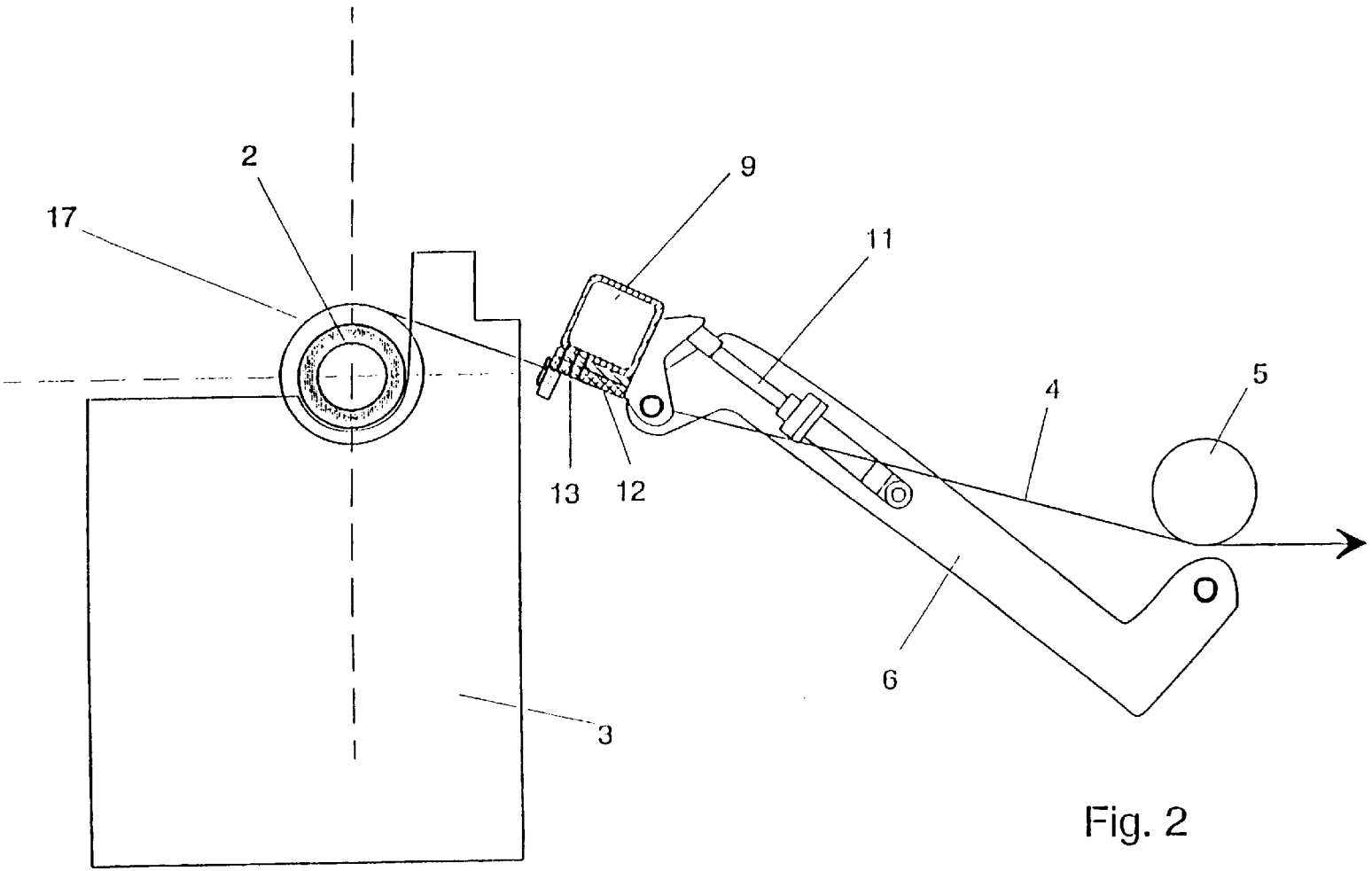
Figure 4:
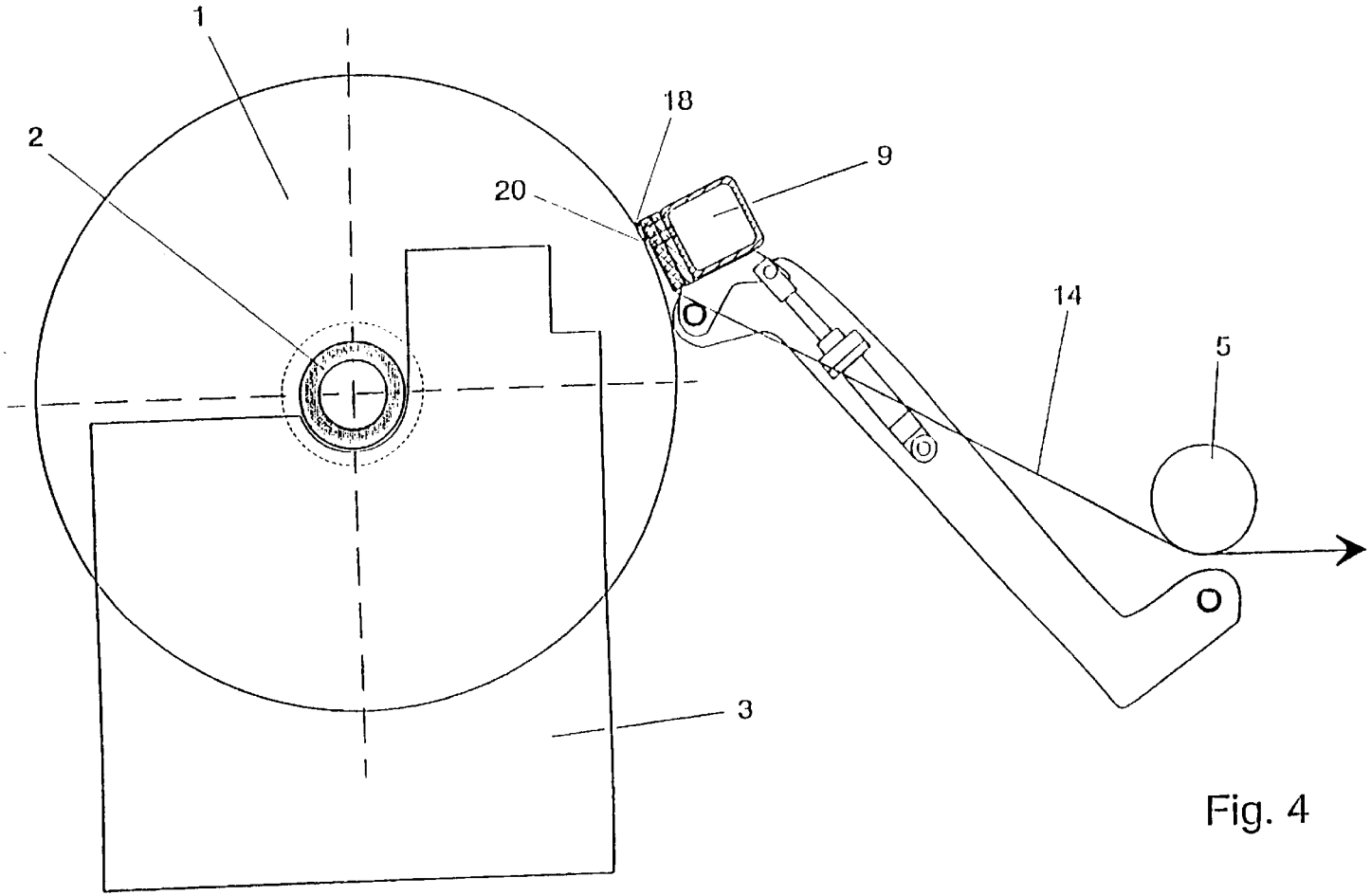

The pivot levers 6 with the splice beam fastened thereon are so constructed and mounted that the splice beams can be swung from its rest position which does not interrupt the travel of the web 4 toward the web 4 running off from the rest roll 17 as has been illustrated in FIG. 2. At the same time, the splice beam 9 can be moved with its front walls 12 against a newly introduced fully wound roll 1. This position is shown in FIG. 4. The apparatus also includes a separating device for separating the web 4 and a device 15 for applying an adhesive strip 18 over the entire web width and along the web end of the running-off web 14 which is formed by the separation and which is only illustrated in FIGS. 1 and 2.

Figure 5:
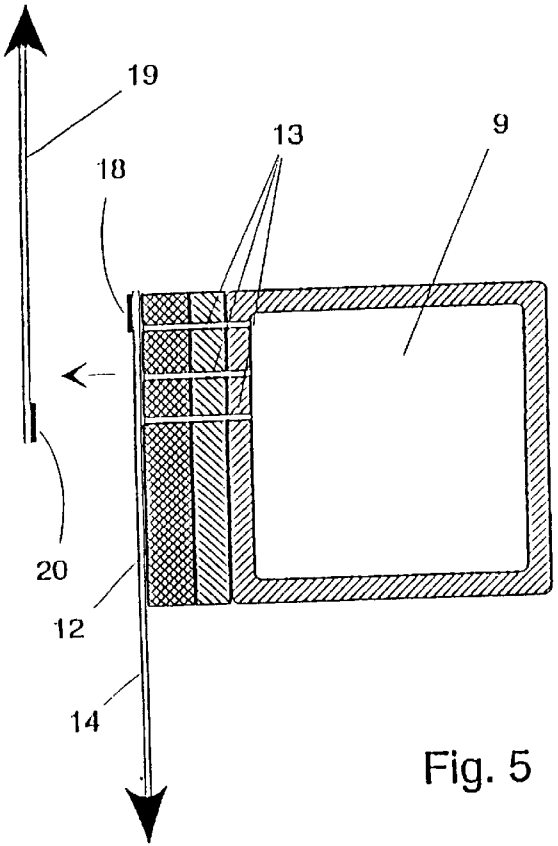

The web separating device 16 is so arranged that the web which is held by suction against the front wall 12 of the splice beam, can be separated transversely along the rear edge of the front wall 12 as referred to the web travel direction. Preferably a circular blade traveling transversely over the entire working width is used as the separating device 16 and is mounted on the splice beam 9. The device 15 for applying an adhesive strip 18 to the end of the running-off web 14 is comprised preferably of a transversely displaceable adhesive tape dispenser which also is shiftably mounted on the splice beam 9. The adhesive strip applying device is so arranged relative to the web separating device 16 that the adhesive strips, as shown in FIG. 5, are applied directly along the edge of the trailing end of the running-off web 14 so that no web residue or only a minimal small residue of free web projects.

FIG. 1 shows the splice device in its rest position while the web 4 is unwound from the wound roll 1. The splice beam extending over the web width is swung upwardly into a rest position which does not interfere with the travel of the beam 9.

When the wound roll 1 has been unwound to form a rest roll 17 with at least three to four paper layers remaining thereon (as a residue), the unwinding process is braked. With the web 4 brought to standstill, the splice beam 9 is moved against the taut web 4 whereby its front wall 12 is simultaneously oriented parallel to the web and lies flatly thereagainst with its surface forming a suction zone. A suction is generated in the splice beam 9 with the suction blower so that the web 4 adheres to the front wall 12 (FIG. 2). Then an adhesive strip 18 is applied to the web 4 by an adhesive tape dispenser 15 and the web 4 is separated directly behind the applied adhesive strip 18 relative to the web travel direction, by the separating device 16. The end of the separated runoff web 14 is held by the splice beam 9 and the adhesive strip 18 runs directly along the end of the run-off web 14 as shown in FIG. 5. Its distance from the web end is less than 10 mm and preferably less than 5 mm.

Figure 7:
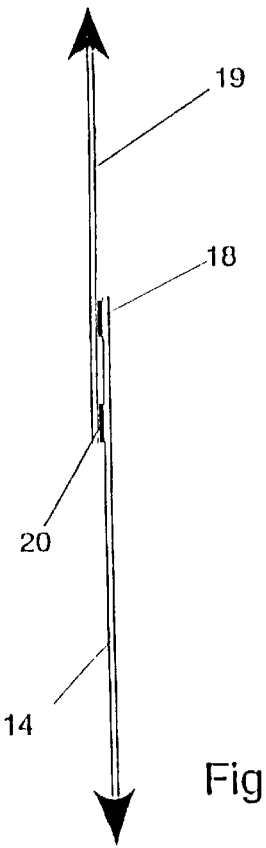
FIG. 7 is a section through the connecting region of the two webs.
Figure 6:
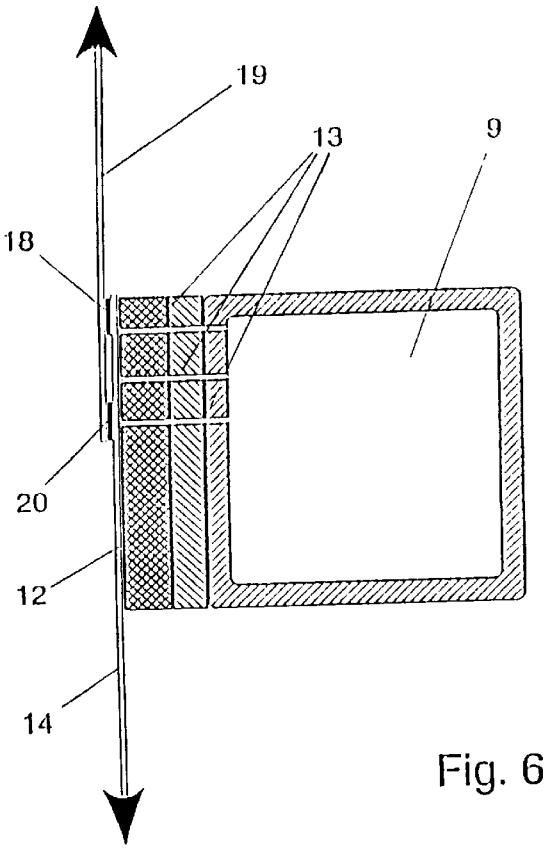
FIGS. 5 and 6 are sectional views which show, in an enlarged illustration, a splicing element and its operation.

Next the splice beam 9 is swung upwardly with the end of the runoff web held thereby and the rest roll 17 is replaced in the unwinding apparatus by a new fully wound roll 1. The new fully wound roll 1 is so prepared that along its exterior and at its web beginning 19, an adhesive strip 20 is applied (FIG. 3). The adhesive strip 20, preferably also a double-sided adhesive tape, is so affixed on the exterior of the web beginning 19 with no web residue or only a reduced web residue projecting beyond it. The new wound roll is so positioned in the unwinding apparatus that with the subsequent movement of the splice beam 9 against the new wound roll, the web end of the runoff web 14 is moved somewhat overlappingly against the web beginning 19 of the new wound roll (FIGS. 4–6). The overlapping of the two webs thus amounts to less than 200 mm and preferably is about 100 mm. The adhesive strip 18 on the runoff web end is so moved against the web beginning 19 that it is bonded adhesively thereto directly behind the adhesive strip 20 at the web beginning 19. The web connection shown in FIG. 7 results and has a web end adhesively bonded to the web beginning 19 by means of the adhesive strip 18 while the web beginning 19 is adhesively bonded to the end of the web 14 by means of the adhesive strip 20. Thus free nonbonded web residues which might cause problems in a subsequent processing machine are avoided.

We claim:

1. A method of connecting a trailing end of a web running off an unwinding roll with a leading end of a new wound roll to replace the unwinding roll in the unwinding of a web, said method comprising the steps of:

(a) separating a trailing end of a web running off an unwinding roll at an unwinding station from a roll residue on the unwinding roll, thereby forming a rest roll;

(b) applying a first adhesive strip to said trailing end and holding said trailing end with a splice element;

(c) while said trailing end is held with said splice element replacing said rest roll at said station with a new fully wound roll having a second adhesive strip on a leading end of a web of the fully wound roll; and (d) thereafter pressing said trailing end with said first adhesive strip against said leading end with said second adhesive strip using said splice element to bond said first adhesive strip to said leading end and said second adhesive strip to said trailing end, thereby connecting said leading and trailing ends.

2. The method defined in claim 1 wherein the first adhesive strip is pressed against the leading end of the new fully wound roll behind the second adhesive strip with respect to a web travel direction in the unrolling of the rolls.

3. The method defined in claim 1 wherein said first adhesive strip is applied to the trailing end upon cutting thereof from the roll residue on said rest roll.

4. The method defined in claim 1 wherein the first adhesive strip is applied to said trailing end of the web running off said unwinding roll at a location less than 10 mm from the trailing edge of said trailing end.

5. The method defined in claim 4 wherein said location is less than 5 mm from said edge.

6. An apparatus for connecting a trailing end of a web running off an unwinding roll with a leading end of a new wound roll in replacement of the unwinding roll in the unwinding of a web, said apparatus comprising:

a web unrolling station receiving an unwinding roll from which a web runs off;

a device for separating the web running off said unwinding roll to form a trailing end of said web and a residue on said unwinding roll whereby said unwinding roll forms a rest roll at said station;

a splice element on said device for holding said trailing end and applying a first adhesive strip to said training end;

means for replacing said rest roll with a fully wound roll having a second adhesive strip on a leading end of a web of the fully wound roll; and means for pressing said splice element and said trailing end held thereby with said first adhesive strip against said fully wound roll so that said splice element spans both of said adhesive strips whereby said first adhesive strip is bonded to said leading end and said second adhesive strip is bonded to said trailing end by the pressing of said spliced element against said fully wound roll thereby connecting said leading and trailing ends.

7. The apparatus defined in claim 6 wherein said device for separating is provided along said splice element and adjacent a surface pressing said trailing end against said leading end and spanning both of said adhesive strips.

8. The apparatus defined in claim 6 wherein said splice element is comprised of a splice beam extending over a working width of said web and pivotally mounted on a pivot lever, said splice element being hollow and having a front wall provided with a row of suction channels opening toward said trailing end, an interior of said splice beam being connected to a suction blower.

* * * * *